United States Patent [19]

Reil

[11] Patent Number: 4,703,876

[45] Date of Patent: Nov. 3, 1987

[54] PACKAGE FOR MATERIAL CAPABLE OF FLOW

[75] Inventor: Wilhelm Reil, Bensheim, Fed. Rep. of Germany

[73] Assignee: Tetra Pak Developpement S.A., Pully, Switzerland

[21] Appl. No.: 20,136

[22] Filed: Feb. 25, 1987

Related U.S. Application Data

[60] Continuation of Ser. No. 811,933, Dec. 20, 1985, abandoned, which is a division of Ser. No. 511,787, Jul. 7, 1983, Pat. No. 4,581,008.

[30] Foreign Application Priority Data

Jul. 17, 1982 [DE] Fed. Rep. of Germany ..... 3226879

[51] Int. Cl.[4] ..... B67D 3/00; B65D 5/72

[52] U.S. Cl. ..... 206/621.2; 222/541; 222/572; 222/527

[56] References Cited

U.S. PATENT DOCUMENTS

| | | | |
|---|---|---|---|
| 3,339,820 | 9/1967 | Krzyzanowski | 206/620 X |
| 4,327,883 | 5/1982 | Kuchenbecker | 229/17 R X |
| 4,546,884 | 10/1985 | Kuchenbecker | 206/620 X |

FOREIGN PATENT DOCUMENTS

| | | | |
|---|---|---|---|
| 2801404 | 7/1979 | Fed. Rep. of Germany . | |
| 2928331 | 1/1981 | Fed. Rep. of Germany | 229/17 R |
| 2928105 | 1/1981 | Fed. Rep. of Germany | 229/17 R |

*Primary Examiner*—Joseph J. Rolla
*Assistant Examiner*—Gregory L. Huson
*Attorney, Agent, or Firm*—Dann, Dorfman, Herrell & Skillman

[57] ABSTRACT

Described are opening means on a package for liquid. The pouring spout (3) can be formed by being torn open along a perforated line (8*a*, 8*b*) which begins at a starting point (14) below the front tip (17) and which terminates approximately in the middle of the upper end wall (6, 6'). In order to provide an air space of sufficient size above the liquid in the package, and an air entry space at the rearward end of the cut, so that the pouring jet of liquid can be accurately guided in passing over the front tip of the pouring spout, the invention provides that the perforated line (8*a*, 8*b*), in the lower triangular portion (13, 13') of the triangular flap, has a bend point (10) from which its path towards the outer, lower starting point (14) is directed markedly more sharply towards the bottom, and that a continuous cut line is provided in the starting point (14).

4 Claims, 7 Drawing Figures

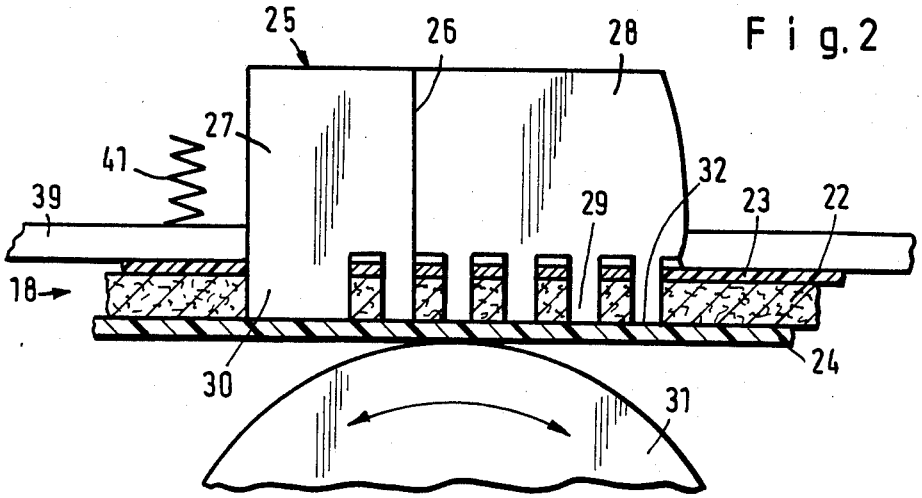
Fig. 2
Fig. 3
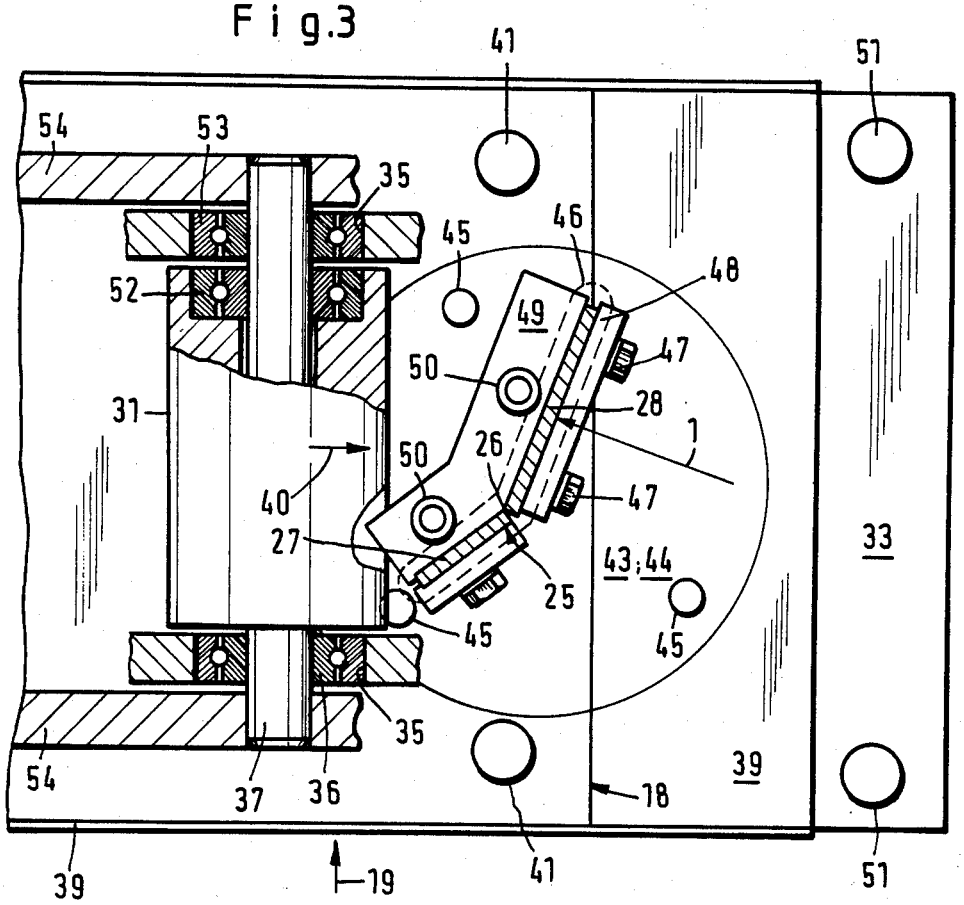

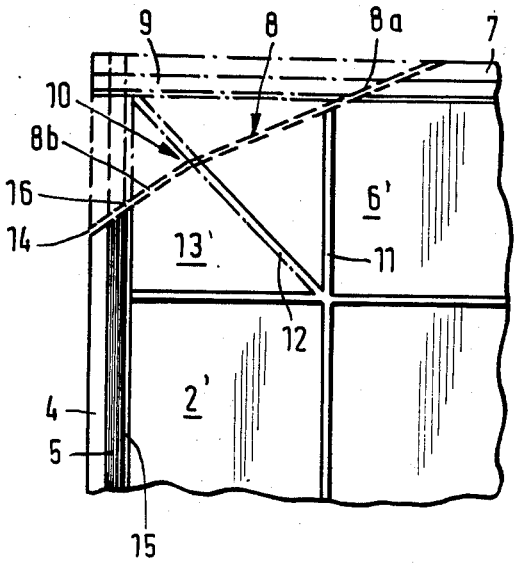
Fig. 6
Fig. 7
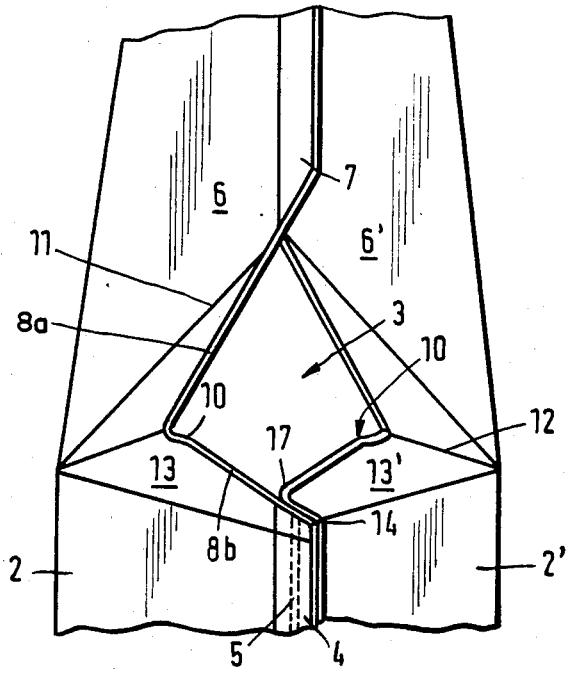

PACKAGE FOR MATERIAL CAPABLE OF FLOW

This is a continuation of Ser. No. 811,933, filed Dec. 20, 1985, now abandoned, which is a division of application Ser. No. 511,787 filed July 7, 1983, now U.S. Pat. No. 4,581,008 dated Apr. 8, 1986.

BACKGROUND OF THE INVENTION

The invention relates generally to an opening means on a parallelepipedic package or carton for pourable material. The package or carton, has four side walls, a bottom and a top end wall formed of a multi-layered carrier material such as cardboard which is coated on both sides with plastic material, and at least one longitudinal sealing seam. The sealing seam extends into a pouring spout, in at least one side wall. The package or carton also has at least one transverse sealing seam in the bottom or the top wall. The package or carton is provided on two sides with double triangular-panel flaps each having inclined stamped or embossed lines. The base of the flap is formed by an end stamped or embossed line. The interior of the flap communicates, along the base, with the interior of the package or carton, to form the pouring spout. The pouring spout can be made operative by tearing open along a perforated line extending through both layers or plies of the triangular panel flap. The perforated line begins at a starting point under the front tip of the pouring spout crosses the end embossed or stamped line, and terminates approximately in the middle of the top wall.

Parallelepipedic packages or cartons for milk or juices, of that kind, are known, which are opened by a procedure wherein one of two triangular flaps is folded downwardly on to a side wall and is there secured in position. The flap is released, lifted up into the plane of the top end wall and pressed flat, whereupon for example a pair of scissors may be used to make a straight cut across the tip of the triangular flap, to form the pouring spout. An effort has been made to provide opening means for liquid carrying cartons of that kind, which do not require a separate tool which in many cases is not available to the final consumer.

To provide an opening means for such a package, it is also already known to provide a perforated line which obviously must be formed in the packaging material (plastic-coated cardboard) in such a way that the cardboard nonetheless still remains fluid-tight. A fluid-tight perforation of this type is achieved by applying a cover strip in the form of a plastic film to the perforated region on the interior of the package wall. It will be appreciated that such a sealing arrangement is expensive, due to the separate material used or the additional step required to be performed. It is undesirable for that reason.

When making an opening cut or when providing one of the known perforated lines, it is desirable for the initial cut at the front lower starting point to be arranged, approximately in the middle of the lower triangular panel of the flap at such an inclined angle that the starting point for the cutting operation is as high as possible and as close as possible to the transverse sealing seam. The reason for this arrangement is to give the maximum size of head space or air space above the level of liquid in the package, directly after the package is opened. If such arrangement were not provided the liquid would run out of the opening as soon as the first cut were made.

If the longitudinal sealing seam extends along the side wall, in the vicinity of which the triangular panel flap is disposed, that is to say, if the longitudinal sealing seam extends into what subsequently forms the pouring spout, a cut or tearing line is formed which extends across the longitudinal seam at a more or less inclined angle and which extends in an essentially linear configuration. The consequence of this configuration is that the outer, lower starting point from which the cutting action or the tearing operation begins takes up a position which is comparatively high beside the front tip portion of the pouring spout. The disadvantage of this arrangement is that the material flow follows the cut or tear line, along the line which crosses the longitudinal sealing seam, so that the material flow is not formed and guided solely by the front tip portion of the pouring spout. Consequently, the liquid spills or dribbles, because a part of the material flow comes away from the edge at the lower starting point. This result is undesirable. Hitherto, no way of overcoming this disadvantage has been found. The use of a steeper angle would result in the general configuration of the perforated or cut line being inclined excessively downwardly. Furthermore when the material is poured out of the package, there would not be the necessary air space above the level of material therein. In addition, the rearward end of the line for tearing off or cutting off the triangular tip portion for forming the pouring spout would be disposed so far forwardly towards the top of the pouring spout that, when pouring out the material, it would not be possible for sufficient air to flow into the carton, to provide for compensation of the volume of liquid discharged therefrom. This results in a poor pouring effect because the material flow begins to pulse. The consumer refers to this condition as the material "slopping out of the carton".

The object of the present invention is therefore to provide opening means on a parallelepipedic package or carton of the kind set forth above, which makes it possible to provide a sufficiently large head space or air space on the one hand, and to provide an air entry space at the rearward end of the pour spout defined by the cut or the line on the other hand, but principally to avoid having the starting point of the spout being at an excessively high position, so that the material can actually flow in a precisely controlled manner over the front tip portion of the pouring spout and the adjacent edges thereof.

SUMMARY OF THE INVENTION

According to the invention, the above described objects are realized by the perforated tear line in the lower triangular portion of the triangular paneled flap, having a bend point from which its path to the outer, lower starting point is directed markedly more sharply towards the bottom, and that a continuous cut line is provided at the starting point. Although, with reference to the embodiments described hereinafter, it is assumed that the perforated line is straight, there are however other forms which give comparatively good opening means. Such forms of opening means may also have the bend point which is provided in accordance with the invention. Such forms of opening means may also have the bend point which is provided in accordance with the invention, such that the path of the line to the lower starting point is directed more steeply towards the bottom, from the bend point, in a forward direction, towards the longitudinal sealing seam. By virtue of this arrangement, the critical starting point is displaced downwardly away from the front tip of the pouring spout. The edge which crosses the longitudinal sealing seam thus extends to such a depth that the material which flows out over the front tip of the pouring spout no longer follows that line, and does not seek to flow away over the starting point on the cut. This arrangement overcomes the disadvantages which are found in the prior art. In order to facilitate the tearing operation and in order to ensure that the lower starting point is in the precise position required, it is desirable to have a cut line disposed in the region of the starting point, not only a portion or residual region of the preforated line. The material generally used for packages in cartons of the type described above is known to suffer from certain tolerances. Packages or cartons of the kind indicated above are mass produced in short periods of time, filled, and issued by machines in which certain tolerances must be allowed. Therefore, care should in fact be taken to ensure that, at the outer, lower starting point, beside the initial cut, the starting line is in fact a cut.

The opening part of this specification has described the position of the inclined embossed or stamped line which forms the outer or hinge edge of the double-triangular panel flap. If the package or carton and the pouring spout are viewed from the front, then it can be seen that two inclined stamped lines extend from below, in an outward direction and then towards the center at the top. If the carton is viewed from the side, and possibly also in a flat condition, then the description herein will be facilitated, for it is sufficient to refer to the single inclined stamped line which is at the front, especially as the other such line in the second flap is directly in alignment therebehind. Referring now to the above-described configuration of the perforated line, beyond the bend point, the carton is best viewed from the side as if it were laid flat. As viewed from the middle of the carton, towards the front edge under the pouring spout, the longitudinal sealing seam is at the front outer edge. The longitudinal sealing seam is a double-layer strip of cardboard in which a sealing line is disposed. That provides a fluid-tight seal at the longitudinal sealing seam. The double-layer strip of cardboard forming the longitudinal sealing seam is somewhat wider than the sealing line itself. The longitudinal boundaries of the longitudinal sealing seam are, on the outward side, the end edge and on the inward side, a stamped or embossed limit line which extends parallel to the longitudinal sealing seam. When cutting or tearing open the carton to form the pouring spout, the above-mentioned perforated tear line crosses the longitudinal sealing seam at the stamped limit line which intersects it at an angle. This arrangement defines a limit point at which the above-mentioned bend point should lie, forward towards the longitudinal sealing seam. A second limit point is formed by the intersection of the perforated line and the stamped or embossed inclined line.

Therefore, in accordance with the invention, it is desirable for the bend point to be disposed on a line which extends from the embossed or stamped inclined line to the embossed or stamped limit line between the front side wall and the longitudinal sealing seam. The conditions and advantages set forth above are attained if the bend point is disposed at any position on the line referred to above, beginning at the first limit point on the stamped inclined line, to a forward position, to the second limit point, namely at the stamped limit line. It is not desirable for the bend point to be disposed outside the portion of the perforated line, as defined in the above-indicated manner.

In accordance with the invention, it is also advantageous if, in forming the cut line, at the starting point, the cut line is so arranged as to pass through the subsequent severing cut between two successively disposed carton blanks.

It has already been indicated above that, with all the tolerances in the manufacture of the liquid packaging means from cardboard, care should be taken to ensure that there is a clear cut at the lower, outer starting point. In order to ensure that that is the case, the pattern or configuration of the perforated line, or the disposition thereof, with the cut end, should be carefully prepared and correctly positioned in the carton blanks. There is obviously a subsequent severing cut, between two successive carton blanks, If now the cut line is so arranged, in accordance with the invention, that, although it cannot interfere with the weld lines in the longitudinal sealing seams, it is nonetheless arranged at the boundary between two longitudinal sealing seams, in the region of the blanks, in such a way that it extends beyond said subsequent severing cut line, then that certainly ensures that, when the carton blank is formed, there is a clear cut at the starting point of the perforated line.

In accordance with the invention, it is also desirable if the depth of cut of the entire perforated line, including the cut line, extends from the exterior through the outer coating of plastic material and through the carrier material to the interface thereof at the inner coating of plastic material. The opening part of this specification referred to applying cover strips of plastic material to the inside of the package, after the known perforated line had been formed. Attention was also directed to the disadvantage involved in that separate operation of securing a separate strip portion in position by adhesive means. The above-indicated features guarantee the necessary sealing effect, but there is no need for a strip of plastic material to be separately applied to the region of the perforated line. The perforated line comprises a chain of cuts, with the chain following the line and the cuts alternating with web portions of package material which remain therebetween. In accordance with the invention, the cuts are so disposed that they go through the outer coating of plastic material and through the carrier material but not through the inner layer of plastic material which is usually of greater thicknesses in comparison with the outer coating of plastic material. Practice has shown that perforated lines formed in that way form a sufficient weakened portion and line guide action, when tearing open the carton while ensuring a satisfactory seal for transportation purposes.

For the purposes of producing such an opening means on a parallelepipedic package or carton of the kind set out above in the opening part of this specification, the invention provides an apparatus which has a blade corresponding to the configuration of the perforated line. The blade is mounted stationarily over a roller which can be moved at a given spacing from the blade edge. The coated carrier material is movable through the space formed by said spacing. The apparatus for manufacturing a parallelepipedic package or carton having the correct perforated line previously described could not be envisaged among the men skilled in the art, for the reason that it was not possible for economic considerations to provide a perforated line or a cut having a bend point. It was known that, although it was possible to form perforated lines of widely varying configurations in packaging material, it was not possible to form a perforated line having a given bend point in predetermined regions, without incurring excessive cost, while observing the above-mentioned tolerance requirements. If however, in accordance with the invention, the blade is arranged in the manner described hereinbefore and is disposed without contact at a preselected spacing from a roller which can be moved relative to the blade, it is possible to form any desired cut line, and to achieve a precise depth of cut and a precise position in the cut for the bend point. It will be seen that in this way it is possible for the position of the bend point to be very precisely maintained, relative to the starting and terminal points of the perforated line. It is then only necessary to adjust the position of the carrier material to be processed, relative to the blade, possibly by electronic control means.

It is advantageous for the blade to comprise two adjacent flat portions which are arranged at an angle relative to each other and for the blade to be so arranged as to project through an opening in a movable stripper member which is spring-biased against the surface of the carrier material. It is highly desirable for the perforated line to be formed as a straight line or as two straight lines which are separated by a bend point. Blades for forming such lines are easy to produce and can be mounted in a precise fashion, for example by being suitably clamped in position. So that the package material to be processed can be satisfactorily released from the blade, after the cutting operation, the apparatus includes the stripper member, the opening of which closely embraces the outline configuration of the blade, so as to permit precise formation of the cut and disengagement of the paper from the blade.

Another advantage of the invention is that the roller is movably guided in the opening of stationary roller guide means. In the region of the blade, the roller guide means has a horizontal portion and, at the two ends thereof, there are inclined portions which extend at a preselected angle away from the blade. By virtue of the blade's stationary position, the roller guide means can be arranged precisely relative to the blade or the blade carrier so that, in a horizontal portion, the roller is at and is maintained at a precise spacing from the lower edge of the blade. The inclined portions take the roller out of engagement with the packaging material so that, when the roller is in the disengaged positions, the material can be conveyed on through the space below the blade.

It is also desirable, in accordance with the invention, that the roller be mounted with ball bearing means on a shaft which in turn is mounted in separate ball bearing means in the roller guide means and that the diameter of the roller be larger than the diameter of the ball bearing means in the roller guide means. The diameter of the roller must be larger than the diameter of the ball bearing assembly in the roller guide means so that the roller can come into compressive engagement with the paper. However this arrangement also results in different peripheral speeds in respect of the roller on the one hand and the ball bearing assembly thereof on the other hand. That in turn requires the roller to have its own mounting means, with separate shaft mounting means. The features according to the invention take account of all those structural details, and any difficulties in forming the cut along the perforated line are solved in an advantageous manner.

In another preferred embodiment of the invention, it is desirable for two cutting means each comprising a blade and roller, which are connected together by way of a connecting bar member, and disposed at a preselected distance from each other. The connecting bar member is coupled to a reciprocating drive. If, with a suitable carton blank, the above-described perforated line is disposed at the center, at a position where there is no longitudinal sealing seam projecting in a bar-like configuration, then a single cutting arrangement with blade and roller is sufficient. In that case however, it is not possible for the tip portion of the triangular paneled flap to be gripped and torn off by the user of the carton, because the tip portion to be torn off is small. If, alternatively, the longitudinal sealing seam is disposed at the front, under the pouring spout, then an enlarged surface area is realized in respect of the tip portion to be torn off, because the longitudinal sealing seam can additionally be used as a surface for gripping purposes. The doubled perforated line must be of such a configuration that one half is formed in one side of the blank and the other half is formed in the other side. The distance therebetween determines the roller spacing of the connecting bar member, in the apparatus for manufacturing the opening means. The stripper member is disposed in the region of the two cutting devices, that is to say, adjacent to the blade with the movable roller therebelow. The opening in the stripper member is disposed close to the blade and is as small as possible so that the paper is held in a predefined position and the depth of cut can be precisely adjusted.

Further advantages, features and possible uses of the present invention will be apparent from the following description of preferred embodiments, in conjunction with the accompanying drawings in which:

BRIEF DESCRIPTION OF THE DRAWINGS

FIG. 2 shows a view on an enlarged scale of the region in which the roller and the blade engage the package material, all essential parts except the blade, the roller and the material being shown in broken-away form or being omitted;

FIG. 3 shows a plan view of the apparatus with its blade and its roller, also illustrating the stripper member and the package material passing therethrough;

FIG. 6 is a broken-away view of the pouring region of the pack or carton in accordance with the invention, in the condition in which it is pressed flat, the triangular tip portion which is torn away to form the pouring spout also being shown in broken lines thereabove; and FIG. 7 shows a perspective plan view of the pouring spout and the parts of the carton therearound.

DESCRIPTION OF THE PREFERRED EMBODIMENT

Figure 1:
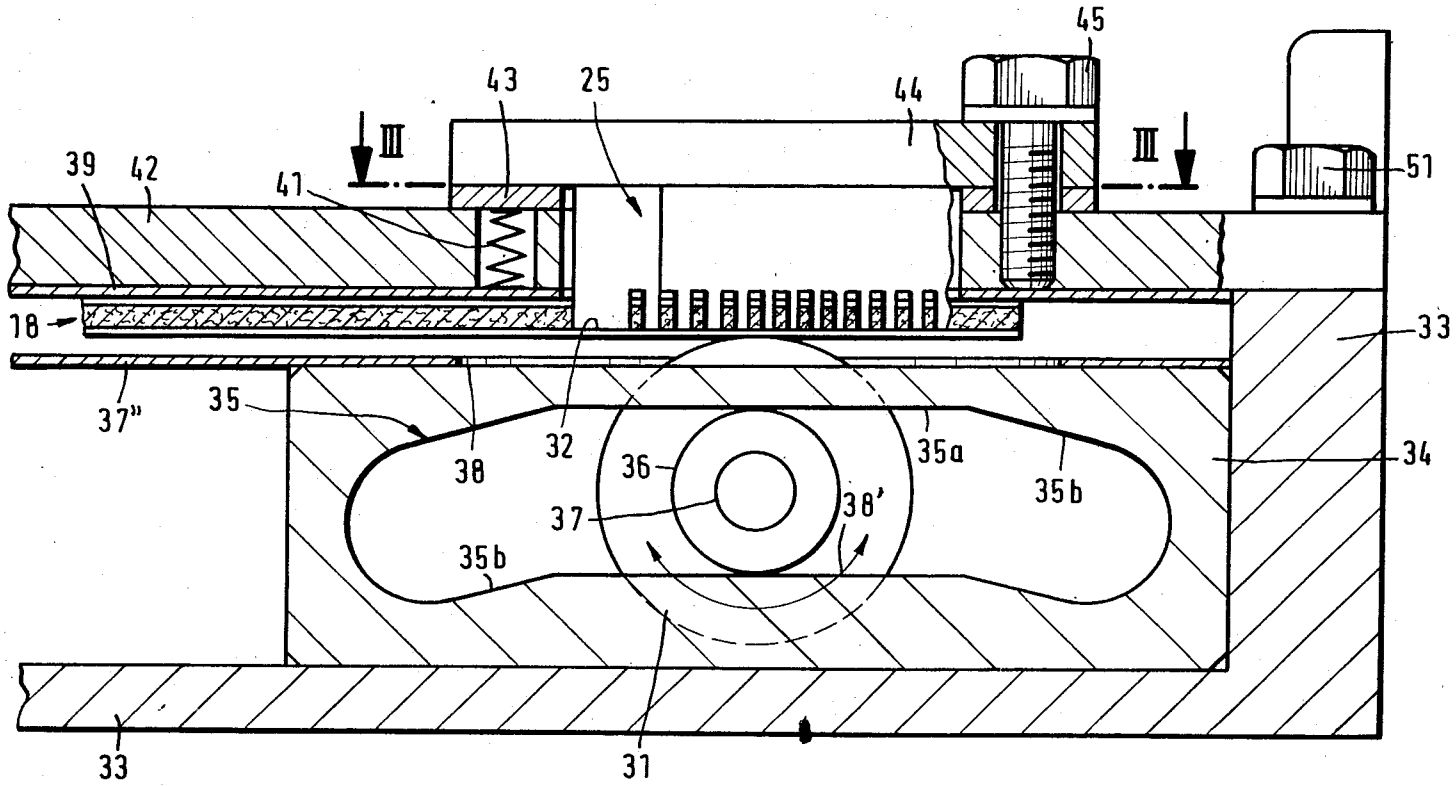
FIG. 1 is a diagrammatic and partly broken-away front view of the apparatus for producing the opening means on the described parallelepipedic package or carton, viewing in the direction indicated by the arrow 1 in FIG. 3.

Reference will first be made to FIG. 7, to provide a better understanding of the pack or carton. Referring now to FIG. 7, there is shown therein, a parallelepipedic pack or carton, having two front side wall portions 2 and 2' which are joined by the longitudinal sealing seam 4. Longitudinal sealing seam 4 extends into the pouring spout 3, and is sealed at weld line 5 to form the front side wall of the package or carton. FIG. 7 also shows the two top end wall portions 6 and 6' which are joined by the transverse sealing seam 7, forming the top wall of the carton. Important features are the lower edges which form the pouring spout 3 and which are formed by the perforated line 8. In this regard, as shown in FIGS. 6 and 7, the perforated line extends between the tip portion 9 of the triangular paneled flap, and the sides of the pack, from the transverse sealing seam 7, in a downward and forward direction. The perforated line 8 includes a rearward straight portion 8*a* which goes from its terminus as far as the bend point 10. The perforated line 8 first crosses the embossed or stamped end line 11 (see FIG. 6) and thereafter crosses the embossed or stamped inclined line 12. The bend point 10 is disposed in the respective lower triangular areas or portions 13 and 13' of the double-triangular panel flap indicated in FIG. 7. From the bend point 10, the path of the perforated line to the outer, lower starting point 14 is angled more steeply towards the bottom of the pack or carton. FIG. 6 clearly shows the different angles of inclination between the portion 8*b* of the perforated line, which is formed between the points 10 and 14, and the other portion 8*a* of the perforated line. Thus, the two straight sections 8*a* and 8*b* of the perforated line are separated by the single bend point 10 which is positioned within the triangular panel flaps. The section 8*b* is at a first acute angle to the transverse sealing seam 7 and the section 8*a* is a second acute angle to the transverse seam 7 which is smaller than the first angle.

The longitudinal sealing seam 4 is bounded inwardly of the package or carton, by the limit or boundary line 15. The intersection between the line 15 and the inclined portion 8*b* of the perforated line 8 is defined as a limit or boundary point 16. If a straight or curved line (which for example follows the perforated line 8) is now drawn from the point 16 to the inclined score line 12, the bend point 10 should be disposed between the point 16 and the line of intersection of the perforated line 8 with the stamped inclined line 12. In the preferred embodiment shown in FIG. 6, the bend point 10 is between those two positions, that is to say, in a position forward of and below the line 12 but above the limit point 16.

FIG. 7 clearly shows the direction in which the perforated line 8 runs. More specifically, by virtue of that arrangement, the starting point 14 in the longitudinal sealing seam 4 is at a lower position in comparison with the front tip 17 of the pouring spout 3, so that, when material is poured out of the package or carton, the discharge stream is actually formed and guided by the edges of the lower triangular portions 13 and 13', which are adjacent to the portion 8*b* of the perforated line 8. The starting point 14 does not interfere with the flow of liquid. Nonetheless, when pouring out the contents of the carton, air can still enter the carton above the discharge stream of material through the upper end of the pouring opening, namely, in the region where the embossed or stamped end line 11 meets the perforated line 8 adjacent to the transverse sealing seam 7 as shown in FIG. 6.

Figure 5:
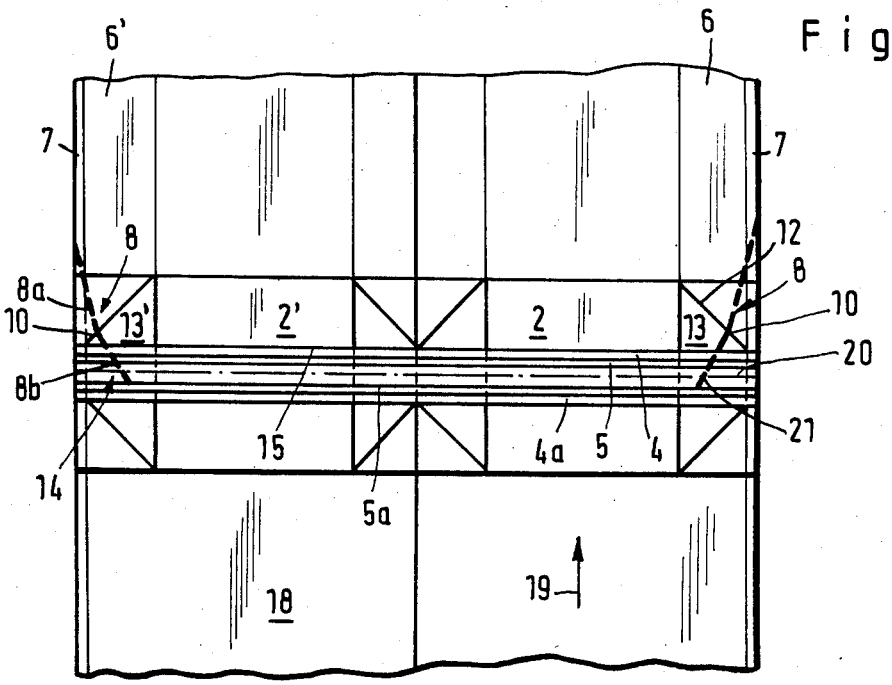
FIG. 5 shows the web of package material with two successive blanks for forming the parallelepipedic pack or carton, to illustrate the arrangement of the perforated line portions.

In the case of the blank for forming the perforated line 8, as illustrated in FIGS. 6 and 7, the arrangement is as shown in FIG. 5. The package material which is generally indicated by reference numeral 18 is conveyed in the form of a web, in the direction indicated by the arrow 19, after it has been taken out of the cutter device which has still to be described herein. The perforated line 8 is therefore already formed. Shown between the lower or first and the upper or second blanks is the severing cut line 20 which extends transversely to the direction of conveying movement of the web of paper material. Disposed above and below the cut 20 is the respective longitudinal sealing seams 4 and 4*a* associated with each of the two adjacent blanks. It will be noted that it is mainly the upper blank that is provided with reference numerals and described herein. The parallelepipedic package or carton, produced by means of the blank shown in FIG. 5, when folded over on the transverse centerline which is parallel to the direction of movement indicated by the arrow 19, not only has the one longitudinal sealing seam 4 but also, at the opposite side, a further longitudinal sealing seam 4*a*, each such sealing seam having a weld line as indicated at 5 and 5*a* respectively. A transverse sealing seam 7 extends between and meets the seams 4 and 4*a* at the top corners of the package. Also shown parallel to the lines 4 in FIGS. 5 and 6 is the embossed or stamped boundary or limit line 15 which intersects the inclined line 12 and the transverse sealing seam 7. The transverse center line, which runs parallel to the direction indicated by the arrow 19, subsequently forms the line in the bottom of the package when the package is formed from the blank. The two wall portions 6 and 6' are connected by the transverse seam 7 to form the top of the package and, in front thereof, the two side wall portions 2 and 2', are joined the the longitudinal weld line 5, as seen near the upper transverse sealing seam as illustrated in FIG. 7.

The perforated line 8 begins with a cut or initial cut portion 21 which traverses the line 20 at which the blanks are subsequently severed to separate the upper blank from the lower blank, it will be certain that there is a cut at the starting point 14, even when the severing cut is slightly above or slightly below the line 20 in the web due to tolerances in the blade cutting edge. From the starting point 14 which is shown in FIG. 5 as the point of intersection between the perforated line portion 8*b* and the severing cut line 20, the perforated line portion 8*b* extends to the bend point 10. There is then a change in the angle or inclination of the perforated line 8, relative to the direction of the arrow 19 and the edges of the web of material which are parallel thereto including those edges which subsequently form the transverse sealing seam 7. The perforated line portion 8*a* then crosses the embossed or stamped inclined line 12, and finally crosses the embossed or stamped end line 11 and then extends along an inclined path into the edge portion which subsequently forms the transverse sealing seam 7.

Because, in the pack formed from the above-described blanks, the longitudinal sealing seam 4 extends into the pouring spout, the user of the package or carton tears off a larger triangular tip portion 9, the area of which can be seen to be enlarged by virtue of the longitudinal sealing seam 7 (see FIG. 6).

The apparatus for production of the precisely shaped and positioned perforated line 8 is shown in FIGS. 1 through 4, of which FIG. 2 shows the arrangement for producing the desired depth of cut. The package material is generally indicated at 18 and include carrier material 22 which, is provided, on the top or outside, with a layer 23 of plastic material such as polyethylene. The inside of carrier material 22 is provided with a layer 24 of similar plastic material, such as polyethylene. Layer 24 is generally thicker than the layer 23. A blade, which is generally indicated by reference number 25, has two flat blade portions 27 and 28 which are separated by a bend line 26. Both blade portions 27 and 28 carry, at their lower ends, comb-like teeth 29 to produce the short cut portions of the perforated line. The blade portion carries a continuous blade edge 30, to produce the continuous cut 21. The roller 31 is disposed at a given spacing from the lower edge 32 of the blade 25. That spacing accurately corresponds to the thickness of the lower plastic coating 24. In that way, it is possible for the depth of cut to be equal to the sum of thickness of the plastic coating 23 plus the thickness of the carrier material 22.

A more detailed view of the construction of the cutting apparatus comprising the blade 25 and the roller 31 can be seen in FIGS. 1 and 3. Secured to a roller guide carrier 33, below the plane with the web 18 of carrier material, referred to herein as the paper plane, is a stationary roller guide means 34 with an opening 35 therein. The stationary roller guide means 34 comprises the three portions forming the opening 35, namely the horizontal central portion **35*a* and the inclined portions 35*b* which adjoin the portion 35*a* outwardly thereof and which are directed at an inclined angle away from the blade 25. The ball bearing mounting means 36 of the shaft 37 of the roller 31 is guided in the opening 35. Disposed on the stationary roller guide means 34 is the lower paper guide means 37″ in the form of a plate which is laid thereover and which has an opening 38 through which the roller 31 passes, by virtue of the movement as indicated by the double-headed arrow 38′**.

The view shown below the paper plane in FIG. 1 is looking in the direction of conveying movement of the paper. That is to say, in FIG. 1, the material 18 is moving away from the reader of the drawing, in a normal direction with respect to the plane of the paper. If, in comparison, attention is directed to FIG. 3 which is a diagrammatic and partly broken-away plan view of the view of FIG. 1, in section taken along line III—III, the direction of view in respect of the lower part of FIG. 1 represents the view of FIG. 3 in the direction of the movement of the paper, as indicated by the arrow 19 in FIG. 3.

However, above the previously mentioned paper plane, FIG. 1 shows a view as viewed in the direction in the arrow 1 in FIG. 3. The reason for the difference in the lines of view in the respective halves of FIG. 1 which are above and below the above-mentioned paper plane is that the essential parts of the invention can in that way be more clearly and rapidly seen from FIG. 1.

The web of paper 18 is passed through the space between the lower paper guide means 37″ and as stripper member 39, in the direction indicated by the arrow 19 of FIG. 3. Such movement is effected intermittently in such a way that the web 18 of carrier material is advanced below the blade 25 until the web of paper is pressed from below against the blade edge 32, to form the perforated line at the correct position. While the web of paper is in motion, the roller 31 is in one of the inclined portions or regions **35*b* of the stationary roller guide means 34. When the web of paper 18 is in the rest condition, the spindle or shaft 37 of the roller 31 is controlled and actuated in such a way that, as viewed in FIG. 3, the roller 31 is moved from the illustrated position towards the right, in the direction indicated by the arrow 40. The roller 31 motion continues until every point of the edge 32 of the blade 25 has made the desired incision in the web of paper. When this operation is complete, the roller 31 disengages from the blade 25, by moving into the other inclined region or portion 35*b*, for example, as shown at the right in FIG. 1**.

The stripper member 39 is arranged loosely below the blade carrier 42, and is resiliently biassed by means of springs 41. In order for the edge 32 of the blade to be at the correct spacing from the roller 31, an adjusting plate 43 of circular flat form is disposed below the blade holder 44 and secured in position by means of screws 45, as can be seen from FIGS. 1 and 3. The stripper member 39 which is arranged movably in a direction normal to the plane of the web 18 of paper presses from above against the web 18 of paper at the coated surface 23 thereof, and presses the web 18 against the roller 31, with a predetermined pressure, so that, after the web of paper 18 engages the blade 25, the latter can be easily and precisely drawn out of the web of paper again. The compression springs 41 are weak so that the stripper member 39 produces only a small amount of friction during the motion phase of the paper web 18.

FIG. 3 also shows an opening 46 in the stripper 39. The opening 46 is formed relatively close to the cutting edge 32 at the bottom of the blade portions 27 and 28, that is to say, close to the blade 25 and has a small area so that the paper web 18 is held in a defined position and the depth of cut can be precisely adjusted.

The bend line 26, can also be seen in FIG. 3, between the two blade portions 27 and 28. Bend line 26 clearly determines the location of the subsequently-formed bend point 10 in the perforated line 8. The blade 25 is clamped by means of screws 47, with a clamping member 48, to a securing block 49 which in turn is mounted on the blade carrier 42 by means of screws 50, on the top thereof. The blade carrier 42 is secured by means of screws 51 to the roller guide carrier 33. Shown below the stripper member 39 which, in FIG. 3, projects beyond the right-hand edge of the paper web 18, is the roller 31 which, before it comes into action, is disposed in the illustrated position, being moved in the direction indicated by the arrow 40, for producing the perforated line 8. FIG. 3 also shows the shaft 37 of the roller 31 first ball bearing means 52 with which the roller 31 is mounted with respect to the shaft 37 and second ball bearing means 53 with which the shaft 37 is guided in the opening 35 in the roller guide means 34. FIG. 3 also shows a respective connecting bar member 54, on the respective outward sides of the above-indicated roller and ball bearing means, the function of the connecting bar 54 being clearly shown in FIG. 4.

Figure 4:
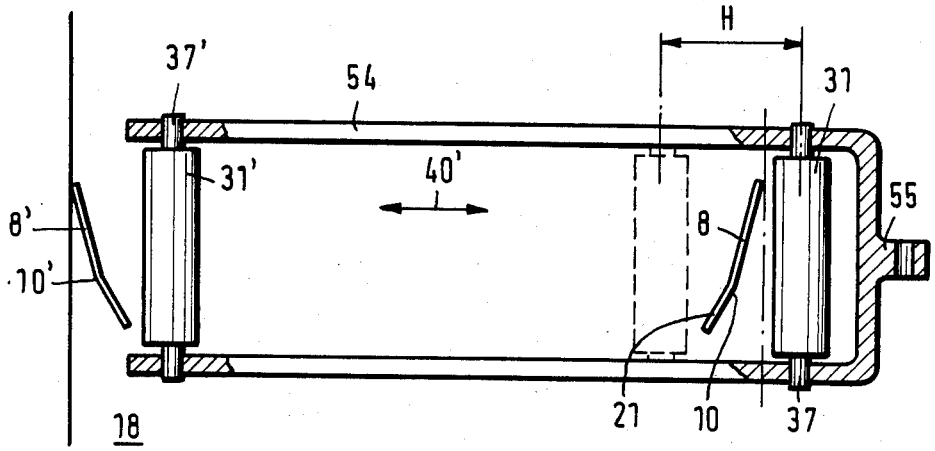
FIG. 4 shows a view of the cutter device in a paired or twinned construction, on a smaller scale, diagrammatically illustrating the positional association with respect to the perforated line in the blank.

FIG. 4 shows the two roller assemblies with rollers 31 and 31′ respectively, which are synchronously movable over the stroke distance H, in the directions indicated by the double-headed arrow 40′. The two roller assemblies are connected together by way of the connecting bar 54 and are connected to a reciprocating drive by means of connecting member 55. FIG. 4 shows the paper web 18 with the perforated line 8 and its mirror-image line 8′ on the left-hand side, with the bend points 10 and 10' respectively, and the cut or starting cut portion 21 which is formed by the blade portion 27 with the continuous blade edge 30.

After the paper web 18 is advanced below the cutting and rolling means, the web is stopped when the blade 25 is in the correct position above the blanks. The reciprocating drive then moves the two rollers 31 and 31' from the position shown in FIG. 4 towards the left. The cuts for making the perforated lines 8 and 8' are effected by passing the rollers over both of the blades.

I claim:

1. An opening means on a parallelepipedic package for filling material which is capable of flow, having when formed into a container four longitudinal side walls, a bottom and a top transverse end wall (6,6') comprising carrier material (22) such as cardboard, which is coated on exterior and interior sides with plastic material (23, 24), at least one selected side wall having a longitudinal sealing seam (4, 5), and at least one selected end wall having a transverse sealing seam (7) both seams having an outwardly projecting free edge and meeting at a selected corner of the package, said opening means comprising a pouring spout formed at the corner where said selected walls meet by a double-layer triangular flap, one layer connected to the selected side wall by a side base score line and the other layer connected to said selected end wall by an end base score line, said score lines meeting each other at two junctions, the two junctions of said base score lines being connected to the selected corner between said transverse and longitudinal sealing seams by two inclined score lines (12), the interior of said flap communicating between the base lines with the interior of the package, perforated lines (8, 8*a*, 8*b*) extending through both layers of the triangular flap adapted to form the opening of said pouring spout, each of the perforated lines beginning at a common starting point (14) in said longitudinal sealing seam between said selected corner and said side base score line to form the front tip (17) of the pouring spout and crossing the inclined score lines and said end base score line and, extending through said transverse sealing seam and terminating at a terminus approximately in the middle of the said one end wall (6, 6'), characterized in that, said transverse sealing seam extends in a continuous straight line along the entire transverse end wall, and between said starting point and said terminus, the perforated line (8, 8*a*, 8*b*) has only two straight sections separated by a single bend point (10), said bend point being positioned adjacent the inclined score lines, the section adjoining the starting point being disposed at a first acute angle to the transverse sealing seam, the section adjoining the terminus being at a second acute angle to said transverse seam, which angle is smaller than said first angle, and a continuous cut line (21) is provided at the starting point (14) through the free edge of said longitudinal seam.

2. An opening means according to claim 1 characterized in that the bend point (10) is disposed between the inclined score line (12) and the longitudinal sealing seam (4).

3. An opening means according to claim 1 wherein said package has a second side wall opposite to the selected side wall, and a second double layer triangular flap is connected between said opposite side wall and the selected end wall by a base score line in said opposite end wall, characterized in that, in addition to the cut line (21) at the starting point (14) in the vertical seam beyond the base end score line of said selected one end wall, a cut line is arranged to sever the free edge of the second longitudinal seam in the second flap beyond the base end score line of said opposite end wall.

4. An opening means according to claim 1 wherein the perforated line is formed by a chain of cuts alternating with web portions along the two sections of the perforated line, characterized in that the depth of cut of the entire perforated line (8), including the cut line (21), extends from the exterior through the outer coating (23) of plastic material and through the carrier material (22) and terminate adjacent the interface thereof at the inner coating (24) of plastic material.

* * * * *